US005378144A

United States Patent [19]

Cress

[11] Patent Number: 5,378,144

[45] Date of Patent: Jan. 3, 1995

[54] METHOD AND APPARATUS FOR TEMPERATURE UNIFORMITY AND REPEATABLE TEMPERATURE AND LOCATION SPECIFIC EMISSION CONTROL OF KILNS

[76] Inventor: Steven B. Cress, P.O. Box 6070, Glenbrook, Nev. 89413

[21] Appl. No.: 844,468

[22] Filed: Mar. 2, 1992

[51] Int. Cl.[6] ..... F27B 9/00

[52] U.S. Cl. ..... 432/120; 432/178; 432/184; 432/196; 432/162

[58] Field of Search ..... 432/120, 121, 159, 162, 432/178, 184, 193, 196, 201, 258

[56] References Cited

U.S. PATENT DOCUMENTS

| | | | |
|---|---|---|---|
| 839,581 | 12/1906 | Harman | 432/162 |
| 2,131,827 | 10/1938 | Vanderpool et al. | 432/184 |
| 2,141,192 | 12/1938 | McCutcheon | 432/120 |
| 2,363,120 | 11/1944 | Drew | 432/178 |
| 2,675,600 | 4/1954 | Dawson . | |
| 3,287,530 | 11/1966 | Dawson . | |
| 3,583,691 | 6/1971 | Twine | 432/196 |
| 3,752,643 | 8/1973 | Robinson | 432/120 |
| 4,464,548 | 8/1984 | Burmeister | 200/33 R |
| 4,531,910 | 7/1985 | Geil | 432/120 |
| 4,692,593 | 9/1987 | Chiu | 432/120 |
| 4,978,295 | 12/1990 | Vukovich, Jr. | 432/120 |

*Primary Examiner*—Henry C. Yuen
*Attorney, Agent, or Firm*—Herbert C. Schulze

[57] ABSTRACT

A method and apparatus for extracting impurities from the interior of a kiln, when in operation, and for creating a uniformly heated atmosphere within the kiln, which involves the introduction of air through an air passage opening through the top of the kiln and affiliated openings in other portions of the kiln through which small amounts of air are drawn and exhausted by means of a blower located within the control panel of the kiln and wherein a kiln setter is maintained free of impurities by drawing air containing impurities past it and away from it by means of said blower.

2 Claims, 3 Drawing Sheets 28
42
14
10
4
30
12
16
100
3
52
18
70
24
32
46
20
86
80
50
56
60a
60
62
66
54
64
88
68

METHOD AND APPARATUS FOR TEMPERATURE UNIFORMITY AND REPEATABLE TEMPERATURE AND LOCATION SPECIFIC EMISSION CONTROL OF KILNS

CROSS REFERENCE TO RELATED PATENT APPLICATIONS

There are no other patent applications related to this application filed by me.

BACKGROUND OF THE INVENTION

I. Field of the Invention

This invention is in the general field of kilns, and the like, and more specifically directed to ceramic kilns land temperature uniformity and environmental concerns;

This invention is even more particularly directed to a method and apparatus for air circulation in kilns during the firing and cooling processes and in removing undesirable gases and pollutants created during the process, the isolating of heating gases in different zones, and combining of components and temperature control in both the firing and cooling phases.

II. Description of the Prior Art

In the past there have been attempts to create desirable venting in kilns by partially opening a door, or by inserting a fan beneath and providing openings of one type or another. None of these have been satisfactory. In the very uncontrolled manner in which the past art has operated there have been frequent problems and certain dangers associated with the movement of gases in and out of a kiln.

The method and apparatus of this invention is unique in that I provide certain minute openings through the top and sides of the kiln and provide a bore within the kiln and beneath the control panel in order to provide adequate movement of a small amount of air and its escape from the kiln itself. The crux of this invention is in the control of air movement within, and outside of the firing chamber, to protect the integrity of articles being fired in different zones, while protecting the temperature control components. In this respect there is no prior art.

SUMMARY OF THE INVENTION

Kilns used in the ceramic arts, principally those used in small studios by artists and the like, are generally totally enclosed. In these kilns it has been the practice to completely fire a number of ceramic articles and the to discontinue the heating and slightly open the top or door to allow a small amount of air to commence to enter and the heated air inside to gradually escape.

Articles being fired have differing characteristics, including, but not limited to, color of glazes used. The firing of ceramic articles in a kiln includes the generation of extreme high temperatures. These high temperatures are difficult to handle, and in addition impurities generated in the firing process can harm the articles being fired. Particularly if gases from one color zone are mixed with those of another, articles can be damaged or destroyed.

Also, escaping gases can be harmful to persons in the vicinity.

I have now conceived and developed a method, and apparatus, for greatly enhancing the effects of the firing process and also greatly enhancing the cooling with a resultant saving of articles which might sometimes otherwise be lost.

I have accomplished this by providing some very small openings through the top, and/or sides and/or bottom of a kiln with appropriate provisions within the kiln, as will be described in connection with the description of a preferred embodiment, such that air is caused to gradually move in the appropriate directions from the atmosphere through the kiln, around the articles being fired, and around the controls and eventually to be exited through the end of the control panel chamber. The exhaust gases are now at a safe temperature.

It is an object of this invention to provide an economical and safe means for circulation of air through kilns during a firing process;

It is another object of this invention to provide such circulation and the exhaustion of impurities;

Another object of this invention is to provide for enhanced temperature control within such kiln;

Another object of this invention is to provide for more uniform distribution of heat within a kiln during the firing process;

Another object of this invention is to maintain temperature and other control components cool in order to enhance the reliability of the kiln setter.

Another object of this invention is to maintain the skin around the kiln at a safe temperature;

Another object of this invention is to maintain air circulation in specific zones within a kiln, said zones being isolated from one another by means of the air flow;

Still another object is to provide for safe cooling after firing has been completed.

The foregoing and other objects and advantages will become apparent to those skilled in the art upon reading the description of a preferred embodiment which follows in conjunction with a review of the appended drawings.

DESCRIPTION OF A PREFERRED EMBODIMENT

Figures 1, 2:
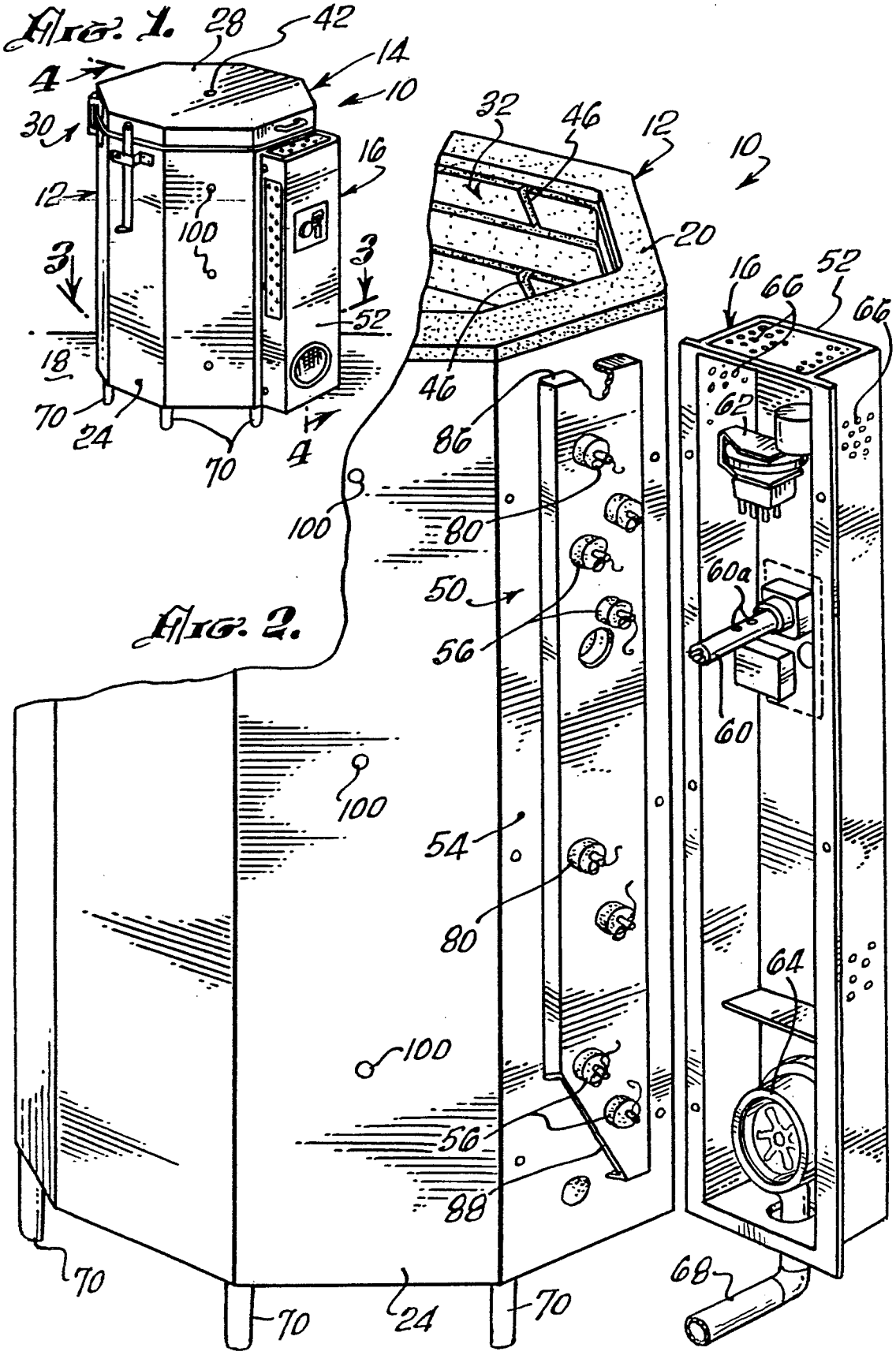
FIG. 1 is a perspective of a kiln suitable to practice the method of this invention.
FIG. 2 is an enlarged fragmentary perspective view, with parts broken away, of the kiln of FIG. 1.

FIG. 1 is a perspective of a kiln 10 suitable to practice the method of this invention. The kiln 10 is composed of a main body portion 12, a bottom closure 22 (shown more clearly in sectional view FIG. 4), a top assembly 14 which is, also, a door through which articles are placed into the kiln, and removed from the kiln; and a control panel 16. The kiln is supported on a surface 18 by means of legs 70. The control panel 16 is in the form of a channel having a front cover 52. A small hole 42 extends completely through the top door for purpose of allowing a small amount of air to enter from the atmosphere to the kiln. Customary viewing holes 100 are provided for purpose of visual observation into the kiln. During the firing process these holes would normally be closed by suitable insulating plugs or the like and only opened for purposes of very short views. The top is hinged at 30 to the kiln body.

FIG. 2 shows portions of the kiln, and particularly the control panel in more detail. The insulating walls 20 of the kiln are shown in this particular example to be octagonal in shape. The exact shape is not critical as is known to those skilled in the art. The kiln may be round, it may be square, or other shapes in cross-section. The method of this invention will be capable of being practiced on any such kiln. In the example shown the opening within the body of the kiln is indicated generally at 32. The inside wall 44 of the insulating body 20 is provided with a number of groove 46 as illustrated.

Figure 3:
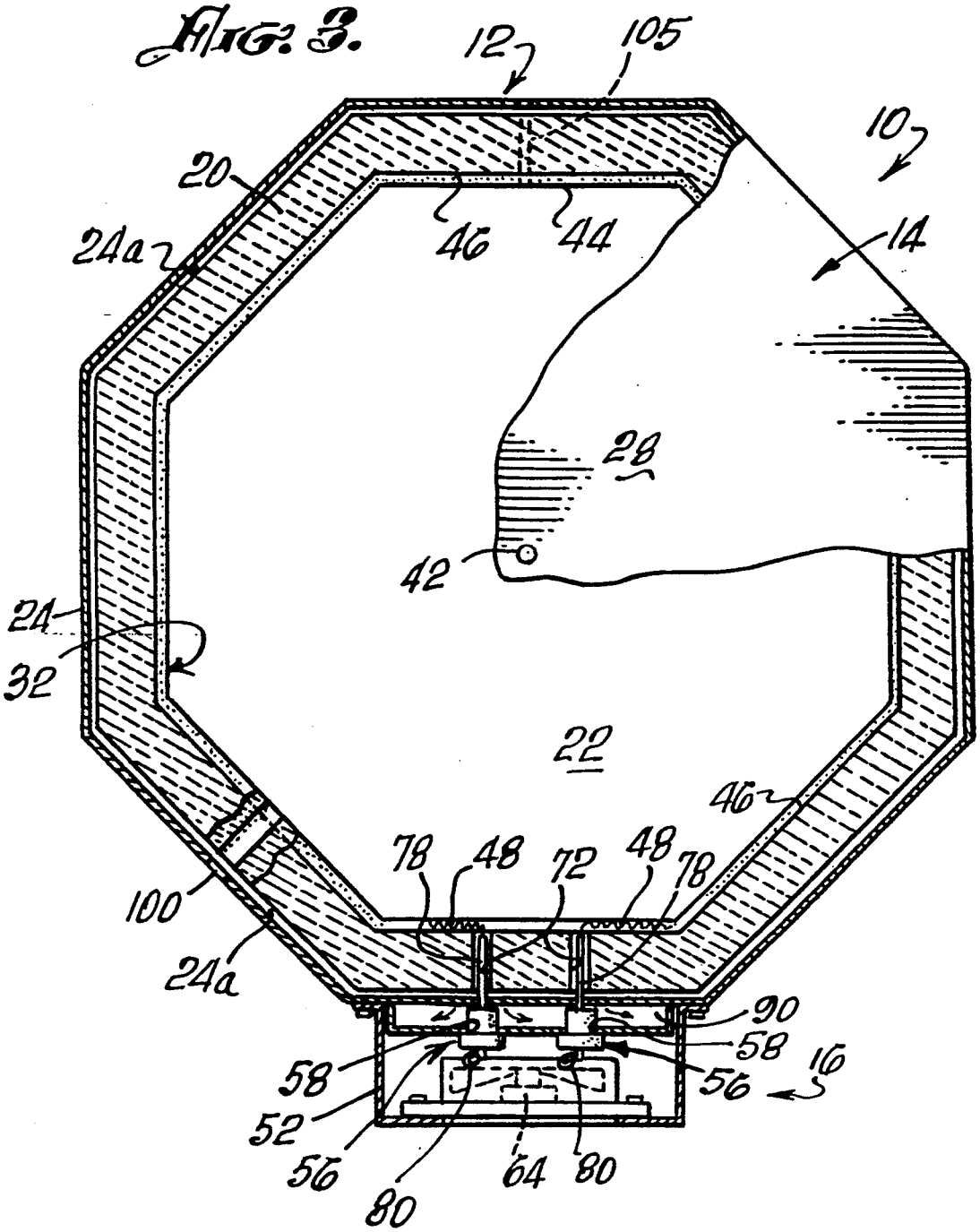
FIG. 3 is a sectional view, partly in elevation, as viewed substantially along the line 3—3 of FIG. 1 in the direction of the arrows.
Figure 5:
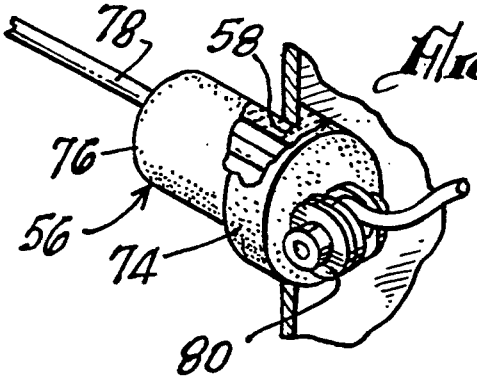
FIG. 5 is a fragmentary perspective view, partly broken away, of an insulating electrical lead member of the invention.
Figure 4:
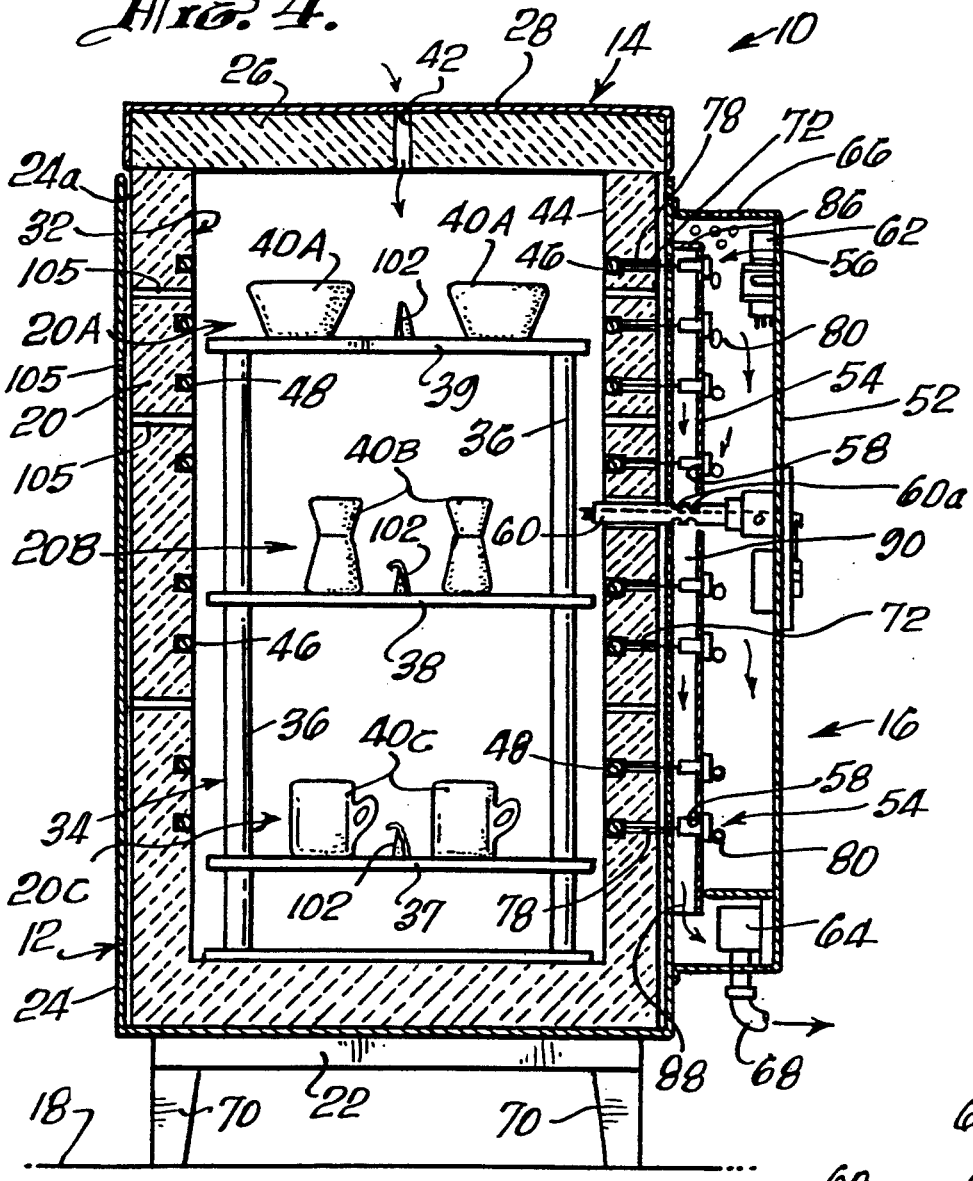
FIG. 4 is a simplified section of the kiln of FIG. 1 as viewed along line 4—4 of FIG. 1 and showing the firing zones.
Figure 6:
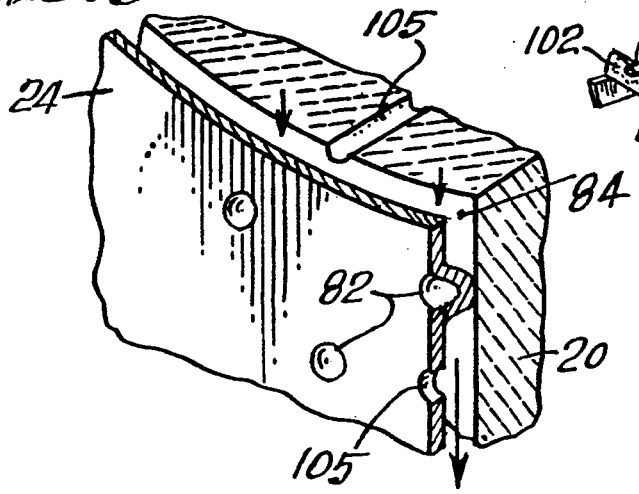
FIG. 6 is a fragmentary perspective, partly in section, the wall construction of the kiln of FIG. 1.
Figure 4A:
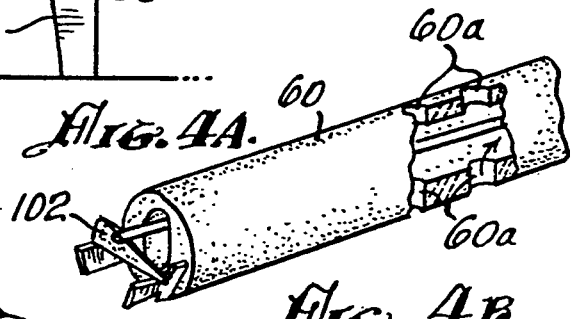
FIG. 4A illustrates the kiln setter.
Figure 4B:
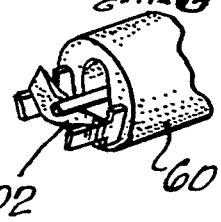
FIG. 4B shows the movement of the firing cone in FIG. 4A.

In viewing FIG. 4 along with FIGS. 2 and 3 a number of other details of the kiln and, in this case, having articles within it to be cured, will be apparent. The exact details of many of the kiln elements are not shown since they will be clear to those skilled in the art. The kiln will preferably have a stainless steel or other suitable exterior skin 24 surrounding the insulating material. Within the kiln there will normally be shelves such as indicated at 37, 38 and 39 supported on posts 36 in a manner known to those skilled in the art. The articles being cured are illustrated at 40A (within firing zone 20 A), 40B (within firing zone 20 B), and 40C (within firing zone 20 C) which numeral has been applied to all articles regardless of their shape, but within a particular zone, since they are only for illustrating purposes and do not form a part of the invention, except as they illustrate a zone in which they are being fired. These zones are important, as is known to those skilled in the art since gases from one zone may adversely affect the articles in another zone, particularly in so far as the color of the glazes is concerned. This is known in the art.

In FIG. 4 the hole 42 is particularly well illustrated and indicates by the arrows the flow of air from the exterior to the interior of the kiln. The numeral 34 has been utilized to illustrate generally the shelf support system. Heating elements 48 are shown located within certain of the grooves of the kiln wall. The control panel is shown to consist of a channel member 50 mounted upon one exterior kiln wall 54, with the cover assembly. A number of insulators 56 for the electrical leads 78 are illustrated. The insulators are mounted with heat control washers 80 as are known in the art. The insulators 56 are generally mounted in openings 58. Kiln setter 60 is mounted as illustrated so that it can enter through the opening 61. A customary timer and/or control 62 is provided as indicated.

An air blower 64 is located within the control panel as indicated. This blower connects to conduit 68 which directs the exhaust from the kiln away from the kiln to a safe location where it will not endanger the operator.

The control panel cover is provided with a number of perforations at 66 in order to allow for full ventilation of the items within the control panel.

Each of the insulators 56 will be shown to consist of an enlarged portion 74 with a reduced portion 76 which passes through the channel 50.

Additional small holes 105, of such size as to allow only a small circulation of air, are provided through the walls of the kiln in such manner that air can circulate not only through the small opening in the top, but also uniformly throughout the kiln. Thus the air will be coming into the kiln's different zones in order to accomplish complete circulation in and around the articles being fired, but largely confined to each individual zone.

Some minor details which have been shown include dimples 82 provided in the kiln skin 24. Because of the venting, the space 84 which may exist between the kiln wall 20 and the skin 24 is kept relatively cool. A timer or temperature control 62 may be provided. The two ends 86 and 88 of the control channel space at 90 provides an air passage way.

By positioning the holes as indicated through the walls of the kiln and through the top of the kiln, the circulation of air, it is apparent, will be complete by reason of the blower drawing air through the control panel and especially around and through the kiln setter to keep this entire area clear and clean and not to allow the build-up of undesirable materials on the kiln setter pivot point. Additionally, and very importantly, by the method and apparatus of this invention heated air is pulled from the interior and through the holes in the kiln setter tube, it set up a barrier and deflects cold air from the outside, thus guaranteeing a uniform and proper flow of heated air from the interior of the kiln over the cone. This, of course, insures proper melting of the cone and proper dropping of the kiln setter (kiln setters are well known in the art and a particularly well known device of this nature is the "kiln-sitter" (a registered trademark of W. P. Dawson, Inc.) and the problem which this ventilation cures is well known) to reflect the correct moment of achieving the proper kiln temperature. The deflected cold air from outside helps keep the pivot point clean.

One last hole has been shown through the bottom of the kiln at 110 which provides for total and complete movement of air in all directions thus drawing off all impurities and creating the maximum clean condition within the heated air in the various zones.

In operation, the kiln is operated in a normal fashion except that by the activation of the blower, which may take place at any time, or be on constantly, air is pulled into the kiln from the top, from the bottom, and from the sides. Thus a turbulent heated air mass is created within the kiln zones which causes even heating and curing of the articles within each zone of the kiln. Additionally, the air traveling as it does and then exiting in separate zones, as well as at other areas in the control panel, causes impurities to be drawn off. Most importantly, the kiln setter pivot point is kept clear of impurities which normally have a tendency to accumulate in that area in a kiln. Collection of impurities at the pivot point causes failure or unreliability.

One further advantage of this invention is the cooling of the kiln skin by the passage of air as shown. This is an important safety advantage, since the skin now reaches a reasonable temperature, thus avoiding dangerous burns by reason of inadvertent contact with the skin. The uniform distribution of air flow as an integral portion of the environmental system is unique.

The mixing of control panel air with heated air so as to exhaust at a reasonable temperature is extremely important. This aids in actively cooling the element wire connections.

The plenum chamber between the kiln and the control box controls the radiation of heat.

The unique method of having the holes through the kiln walls offset from holes 105a through the skin is a particular advantage in that air is preheated in this chamber between the kiln and the skin thus enhancing the quality and efficiency of the kiln operation.

While the embodiments of this invention shown and described are fully capable of achieving the objects and advantages desired, it is to be understood that such embodiments are for the purpose of illustration only and not for the purpose of limitation.

I claim:

1. A kiln for curing ceramic products in which an opening is provided intercommunicating between the atmosphere exterior of the kiln at the top of the kiln and the interior of the kiln; a kiln setter, which is a device within the kiln having a rod resting on a ceramic cone such that the rod drops when the cone melts controlling the heat being generated within the kiln, intercommunicating between a control panel on the exterior of said kiln to the interior of said kiln; blower means installed within said control panel; air passage means between the atmosphere exterior of the kiln and one side of the interior of the kiln; air passage means between the atmosphere exterior of the kiln and through the bottom of the kiln to the interior of the kiln; and wherein the kiln setter includes a tubular portion with two holes extending through a wall thereof.

2. The apparatus of claim 1 wherein the air passage means is so oriented as to maintain flow of air within defined zones within the kiln.

* * * * *